US009099792B2

(12) United States Patent
Kondou et al.

(10) Patent No.: US 9,099,792 B2
(45) Date of Patent: Aug. 4, 2015

(54) CRIMPING TERMINAL

(71) Applicant: Yazaki Corporation, Minato-ku, Tokyo (JP)

(72) Inventors: Takaya Kondou, Shizuoka (JP); Masanori Onuma, Shizuoka (JP); Yoshitaka Ito, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/018,601

(22) Filed: Sep. 5, 2013

(65) Prior Publication Data

US 2014/0004758 A1 Jan. 2, 2014

Related U.S. Application Data

(63) Continuation of application No. PCT/JP2012/000673, filed on Feb. 1, 2012.

(30) Foreign Application Priority Data

Mar. 8, 2011 (JP) ..... 2011-049778

(51) Int. Cl.
*H01R 4/18* (2006.01)

(52) U.S. Cl.
CPC ..... *H01R 4/183* (2013.01); *H01R 4/188* (2013.01); *H01R 4/185* (2013.01)

(58) Field of Classification Search
CPC ..... H01R 4/188; H01R 4/185; H01R 4/18; H01R 4/28; H01R 4/184; H01R 4/203; H01R 4/2495; H01R 4/62
USPC ..... 439/877, 882
See application file for complete search history.

(56) References Cited

U.S. PATENT DOCUMENTS

| | | | | | |
|---|---|---|---|---|---|
| 2,735,997 | A | * | 2/1956 | peterson | 439/882 |
| 3,496,520 | A | * | 2/1970 | Reynolds | 439/442 |
| 3,514,528 | A | * | 5/1970 | Ray | 174/84 C |
| 3,594,702 | A | * | 7/1971 | Frey | 439/442 |
| 3,831,132 | A | | 8/1974 | Bowden, Jr. et al. | |
| 5,370,560 | A | * | 12/1994 | Ito | 439/877 |
| 6,056,605 | A | * | 5/2000 | Nguyen et al. | 439/882 |

(Continued)

FOREIGN PATENT DOCUMENTS

| | | | |
|---|---|---|---|
| JP | 7-135031 | A | 5/1995 |
| JP | 2009259532 | A | 11/2009 |

(Continued)

OTHER PUBLICATIONS

International Search Report for PCT/JP2012/000673 dated Jun. 13, 2012.

(Continued)

*Primary Examiner* — Briggitte R Hammond
(74) *Attorney, Agent, or Firm* — Sughrue Mion, PLLC

(57) ABSTRACT

A crimping terminal includes a conductor crimping portion which is connected to an electric cable so as to crimp the electric cable. The conductor crimping portion includes a bottom plate on which a conductor is placed and a pair of conductor crimping tabs which is provided on both sides of the bottom plate. The conductor crimping portion includes serrations that are formed at least a part of the inner surface thereof and retains the conductor of the electric cable inside the conductor crimping portion and at least one bead that protrudes from the inner surface.

11 Claims, 11 Drawing Sheets

(56) References Cited

U.S. PATENT DOCUMENTS

| | | | | |
|---|---|---|---|---|
| 7,896,715 | B2 * | 3/2011 | Kumakura et al. | 439/877 |
| 8,147,281 | B2 * | 4/2012 | Kuwayama et al. | 439/877 |
| 8,177,591 | B2 * | 5/2012 | Okamura et al. | 439/877 |
| 8,246,394 | B2 * | 8/2012 | Ono et al. | 439/877 |
| 8,485,853 | B2 * | 7/2013 | Seifert et al. | 439/882 |
| 8,622,774 | B2 * | 1/2014 | Seifert et al. | 439/882 |

FOREIGN PATENT DOCUMENTS

| | | | |
|---|---|---|---|
| WO | 2009/128344 | A1 | 10/2009 |
| WO | 2010/007843 | A1 | 1/2010 |

OTHER PUBLICATIONS

Communication dated Dec. 16, 2014, issued by the Japan Patent Office in corresponding Japanese Application No. 2011-049778.

Communication dated Dec. 17, 2014, issued by the Korean Intellectual Property Office in counterpart Korean application No. 10-2013-7026623.

Communication dated Feb. 16, 2015 from the State Intellectual Property Office of People's Republic of China in counterpart Application No. 201280011926.X.

Communication dated Apr. 7, 2015 from the European Patent Office in counterpart application No. 12713790.9.

* cited by examiner

FIG. 5A
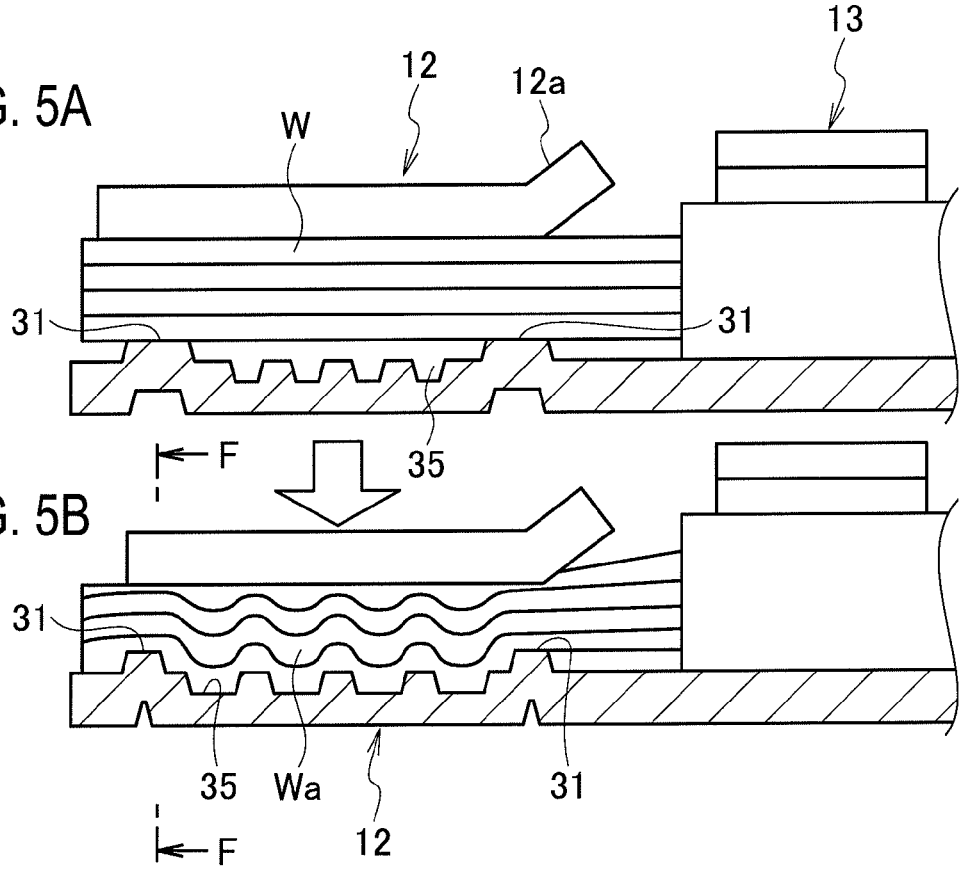
FIG. 5B
FIG. 6
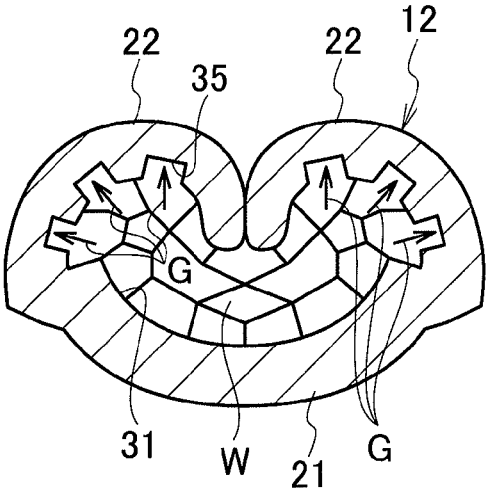

CRIMPING TERMINAL

CROSS REFERENCE TO RELATED APPLICATIONS

This application is a continuation application of International Application No. PCT/JP2012/000673, filed on Feb. 1, 2012, which claims priority to Japanese Patent Application No. 2011-049778, filed on Mar. 8, 2011, the entire contents of which are incorporated by references herein.

BACKGROUND OF THE INVENTION

1. Field of the Invention

The present invention relates to a crimping terminal with a conductor crimping portion.

2. Description of the Related Art

FIGS. 1A and 1B illustrate cross-sections of a conductor crimping portion 512 of a crimping terminal disclosed in Japanese Patent Application Laid-Open No. 07-135031. As shown in these drawings, a conductor W of an electric cable is crimped by the conductor crimping portion 512.

In general, the conductor crimping portion 512 of the crimping terminal includes a bottom plate 521 and a pair of conductor crimping tabs 522 and 522 extending upward from both edges of the bottom plate 521. The conductor crimping portion 512 is formed so as to have a substantially U-shaped cross-section. The pair of conductor crimping tabs 522 and 522 is curled inward so as to wrap the conductor W of the electric cable which is disposed on the inner surface of the bottom plate 521, so that the respective front ends thereof is crimped so as to bite the conductor W.

SUMMARY OF THE INVENTION

Since the crimping terminal with the above-described structure is installed in a vehicle in many cases, the crimping terminal needs to be designed to sufficiently withstand thermal shock. Thus, a sampling test is performed to evaluate thermal shock resistance performance of the crimping terminal. In this test, for example, an environmental temperature with respect to the conductor crimping portion 512 repeatedly alternates between a high temperature and a low temperature, so that stress as thermal shock is continuously applied thereto.

In FIG. 1A, solid lines indicate a deformed shape of the conductor crimping portion 512 at a high temperature, and dashed lines indicate a deformed shape of the conductor crimping portion 512 at a low temperature. Further, in FIG. 1B, solid lines indicate a deformed shape of the conductor crimping portion 512 at a low temperature, and dashed lines indicate a deformed shape of the conductor crimping portion 512 at a high temperature.

As shown in these figures, since the environmental temperature repeatedly alternates between the high temperature and the low temperature, the conductor crimping portion 512 repeatedly expands and contracts as illustrated in FIG. 1A and FIG. 1B like a breathing operation. A result of the above-described test shows an increase in the contact resistance between the conductor and the crimping terminal which repeatedly expands and contracts due to the thermal shock.

This increase of the contact resistance is likely to be due to a decrease in the crimping performance caused by the repeated thermal expansion and thermal contraction. That is, a part of the terminal which covers the conductor W from the outside thereof (that is, the conductor crimping portion 512) may slightly move with respect to the conductor W due to the repeated thermal expansion and thermal contraction. According to the analysis of the movement of the conductor crimping portion 512 of which the crimping performance is degraded, the contact resistance between the conductor W and the terminal may be affected by the large bending deformation or the movement of the bottom plate 521 of the conductor crimping portion 512 or the portion from the bottom plate 521 to the conductor crimping tab 522. Furthermore, the bending deformation is generated from the center portion Q of the bottom plate 521 in its widthwise direction.

In a conventional crimping terminal, if the conductor crimping portion has no sufficient rigidity, a relative movement may be easily generated between the crimping terminal and the conductor of the electric cable when the crimping terminal receives the thermal shock as described above. For this reason, the contact resistance between the terminal and the connection portion of the electric cable may increase, and the electric connection performance may be degraded. Especially, in recent years, there has been a demand for a decrease in the size or the thickness of the terminal. With this current tendency, it is desirable to solve the above-described problem.

Further, the conductor crimping portion has an inner surface with serrations to obtain a satisfactory connection state between the terminal and the electric cable in the structure of the general crimping terminal. The serrations may easily tear an oxide coating which is formed on a contact surface between the terminal and the electric cable by using the edges thereof. As a result, the electric cable and the terminal may be electrically connected to each other satisfactorily.

However, when the serrations are formed in the conductor crimping portion, the thickness of the portion provided with the serrations is thinned, whereby the terminal may be easily stretched in its axial direction (longitudinal direction) during the crimping operation. When the stretching amount increases, the terminal may protrude from a connector housing, for example, in accommodating the terminal into the connector housing. No severe problem occurs when serrations are formed from an array of grooves, but some problem may easily occur when the serrations are formed from scattered square or circular recesses. Especially, when the latter serrations are provided in the inner surface of the conductor crimping portion, the above-described stretching may increase due to its wideness of the area in which the serrations are formed.

Further, when plural recesses that serve as the serrations are formed in the inner surface of the conductor crimping portion, the terminal has high rigidity in an initial state after being produced because of its work hardening. However, when thermal shock is applied to the terminal, the terminal is annealed and softened, so that the rigidity thereof is degraded compared to the initial processing time. As a result, the force for tightening the conductor of the portion provided with the serrations is weakened, and a gap is formed between the terminal and the electric cable. When the gap is formed, the oxide coating is more easily generated from the gap, and this may increase the contact resistance.

The invention is made in view of the above-described circumstances, and it is an object of the invention to provide a crimping terminal capable of effectively improving rigidity of a portion from a bottom plate of a conductor crimping portion to a conductor crimping tab thereof, suppressing an increase in the contact resistance between the crimping terminal and an electric cable as much as possible even when receiving a thermal shock, and suppressing the conductor crimping portion from being excessively stretched in the axial direction.

An aspect of the present invention is a crimping terminal comprising: an electric connection portion; and a conductor crimping portion provided at a back side of the electric connection portion in a lengthwise direction thereof, the conductor crimping portion being connected to a conductor exposed at a front end of an electric cable so as to crimp the conductor. The conductor crimping portion includes: a bottom plate on which the conductor is placed, a pair of conductor crimping tabs configured to crimp the conductor on the bottom plate so as to wrap the conductor, the conductor crimping tabs being formed so as to extend from left and right sides of the bottom plate when seen from the lengthwise direction, serrations configured to retain the conductor inside the conductor crimping portion, the serrations being formed in at least a part of an inner surface of the conductor crimping portion, the part being curled so as to wrap the conductor when crimping the conductor, and at least one bead formed extending in a direction perpendicular to the lengthwise direction and being formed protruding from the inner surface of the conductor crimping portion toward the conductor on the bottom plate, the at least one bead being provided at the back side of the serrations in the lengthwise direction or the back and front sides of the serrations in the lengthwise direction in the inner surface of the conductor crimping portion.

The at least one bead may be formed by stamping a sheet forming the conductor crimping portion from an outer surface of the sheet.

Recesses as the serrations may be independently provided so as to be spaced from each other.

The recesses may be staggered.

The recesses may be formed in a circular shape.

The recesses may have the same shape.

When it is assumed that a grid includes a plurality of quadrilateral unit frames each of which is formed by the recesses serving as grid points, a first diagonal line of each unit frame may be positioned along the lengthwise direction of the crimping terminal, and a second diagonal line of each unit frame may be positioned so as to be perpendicular to the lengthwise direction of the crimping terminal.

The first and second diagonal lines may have the same length.

The first diagonal line may be longer than the second diagonal line. In this case, a recess on the second diagonal line of the recesses may partly overlap the other recess on the first diagonal line of the recesses when seen from the extension direction of the first diagonal line.

The second diagonal line may be longer than the first diagonal line. In this case, a recess on the first diagonal line of the recesses may partly overlap the other recess on the second diagonal line of the recesses when seen from the extension direction of the second diagonal line.

According to the crimping terminal, it is possible to improve the rigidity of the portion provided with the bead in the conductor crimping portion. Thus, the deformation (i.e. the movement causing expansion or contraction) in the event of thermal shock can be suppressed to be small, and it is possible to reduce the relative deviation of the terminal with respect to the electrical cable or vice versa in a boundary therebetween due to the repeated deformation by the thermal shock. Therefore, it is possible to stably suppress an increase in the contact resistance between the terminal and the electric cable.

BRIEF DESCRIPTION OF THE DRAWINGS

FIG. 1A is a cross-sectional view in which a high-temperature state is depicted by solid lines in a thermal shock test. FIG. 1B is a cross-sectional view in which a low-temperature state is depicted by solid lines.

FIG. 3A is an enlarged view of a part A of FIG. 2. FIG. 3B is a cross-sectional view taken along the line B-B of FIG. 3A. FIG. 3C is a cross-sectional view taken along the line C-C of FIG. 3A FIG. 3D is a cross-sectional view taken along the line D-D of FIG. 3A.

FIGS. 5A and 5B are longitudinal cross-sectional views respectively illustrating a state during a conductor crimping portion of the crimping terminal crimps a conductor (a state before the conductor crimping portion strongly crimps the conductor) and a state after the conductor crimping portion crimps the conductor (the conductor crimping portion strongly crimps the conductor so that the crimping operation is completed).

FIG. 6 is a cross-sectional view taken along the line F-F of FIG. 5B.

FIG. 7A is a diagram illustrating the crimping state of the former crimping terminal. FIG. 7B is a diagram illustrating the crimping state of the latter crimping terminal of the embodiment.

DESCRIPTION OF THE PREFERRED EMBODIMENT

Figure 1A:
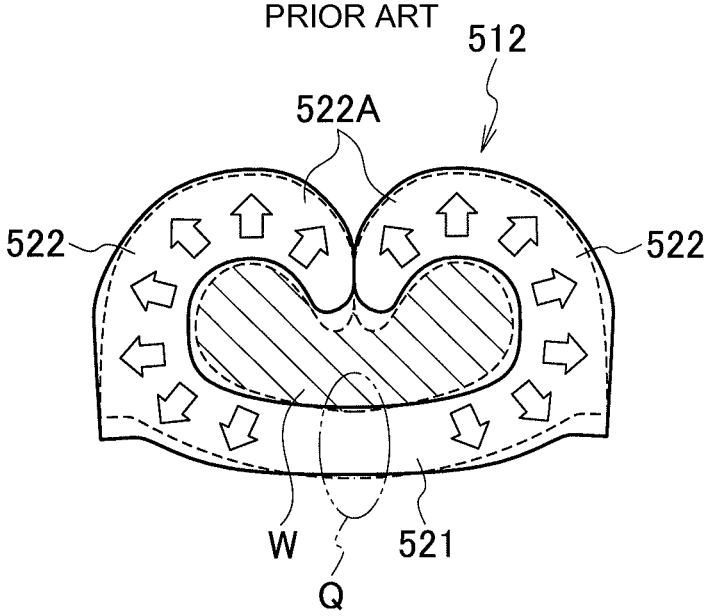
FIG. 1A PRIOR ART
FIGS. 1A and 1B illustrate cross-sections when a conductor crimping portion of a conventional crimping terminal crimps a conductor of an electric cable.
Figure 1B:
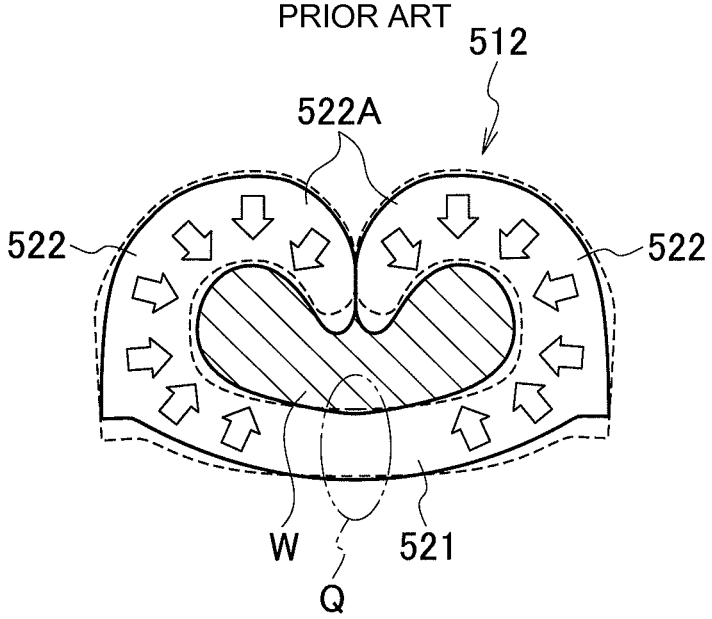
FIG. 1B PRIOR ART
Figure 2:
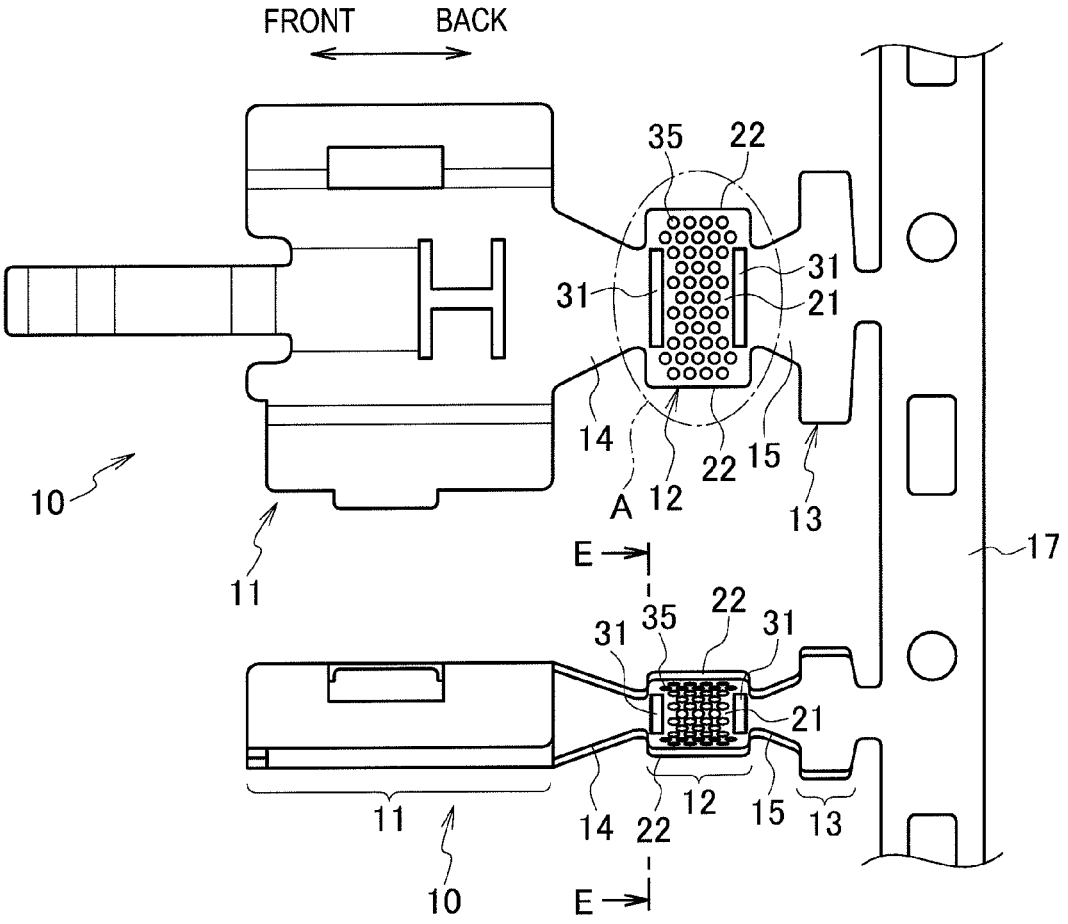
FIG. 2 is a plan view illustrating a shape of a crimping terminal according to a first embodiment of the invention, which illustrates a shape when the crimping terminal is exploded in a press working and a shape when the crimping terminal is formed as a product.

Hereinafter, embodiments of the present invention will be described by referring to the drawings. FIG. 2 is a plan view illustrating a shape of a crimping terminal of a first embodiment of the invention, which illustrates a shape when the crimping terminal is exploded in a press working and a shape when the crimping terminal is formed as a product.

A crimping terminal 10 of the embodiment is produced by pressing one metal sheet, for example. As illustrated in FIG. 2, the crimping terminals 10 are produced like a chain, for example. In this cease, one end of each terminal 10 is connected to a carrier 17. The upper and lower stages of FIG. 2 respectively illustrate the shapes of the crimping terminals 10 before and after the crimping terminals 10 are completely produced. As illustrated in these drawings, with regard to the crimping terminal 10 which is not completely produced yet, one metal sheet is flatly exploded by press-punching.

Here, the relative direction which will be used in the following description will be defined. In the array of the crimping terminal 10 illustrated in FIG. 2, the side where an electric connection portion 11 of the crimping terminal 10 is positioned is defined as the 'front', and the side where a crimp portion (a conductor crimping portion) 12 of the crimping terminal 10 or a sheath crimping portion 13 is positioned with respect to the electric connection portion 11 is defined as the 'back'. Thus, the tensile direction from the 'front' to the 'back' (and the reverse thereof) is referred to as the lengthwise direction or the front-back direction of the crimping terminal. The electric cable which is connected to the crimping terminal 10 by crimping is drawn backward from the sheath crimping portion 13 along the lengthwise direction (the front-back direction). Furthermore, on the drawing paper of FIG. 2, the direction perpendicular to the lengthwise direction is defined as the left-right direction.

As described above, the crimping terminal 10 includes the electric connection portion 11 which is positioned at the front side (the front end side) thereof and the conductor crimping portion 12 and the sheath crimping portion 13 which are positioned at the back side (the back end side) thereof. The electric connection portion 11 is a portion that is electrically connected to a counter terminal when the counter terminal is inserted. The conductor crimping portion 12 is connected to the back portion of the electric connection portion 11 through a connecting portion 14, and crimps the conductor W which is exposed at the front end of the electric cable (for example, see FIGS. 5 and 6). The sheath crimping portion 13 is connected to the back portion of the conductor crimping portion 12 through a connecting portion 15 and crimps the sheath portion of the electric cable. The electric connection portion 11, the conductor crimping portion 12, and the sheath crimping portion 13 are integrally (continuously) formed with each other through the common bottom plate.

Figure 4:
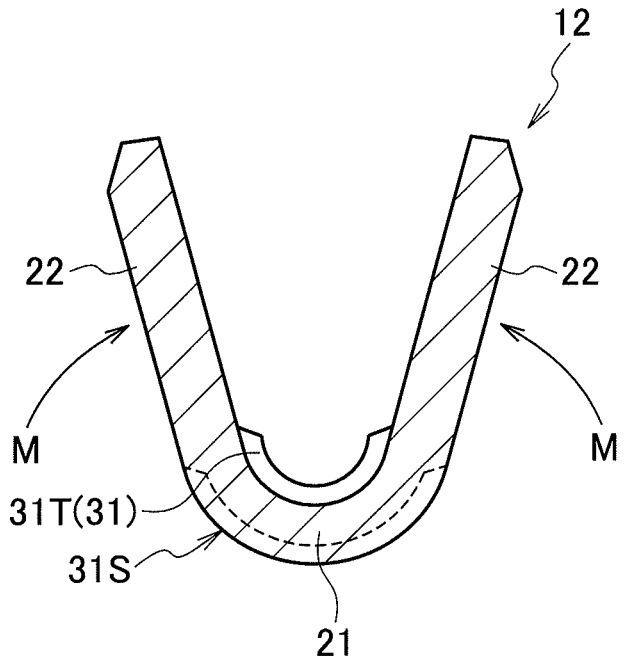
FIG. 4 is a cross-sectional view taken along the line E-E of FIG. 2.

As illustrated in FIG. 4, the conductor crimping portion 12 includes a bottom plate 21 and a pair of conductor crimping tabs 22 and 22, and is formed so as to have a substantially U-shaped cross-section along the front-back direction due to the curvature of the bottom plate 21 through molding in a state before the electric cable is crimped (that is, a state where the conductor crimping portion is completely produced and is not used yet). The bottom plate 21 includes an inner surface on which the conductor W of the electric cable (see FIGS. 5A and 5B) is placed. The pair of conductor crimping tabs 22 and 22 is formed so as to respectively extend from the left and right sides of the bottom plate 21. The conductor crimping tabs 22 and 22 are curled inward so as to wrap the conductor W on the bottom plate 21, and are crimped so that respective front ends of the conductor W bite into the conductor W.

Figure 3B:
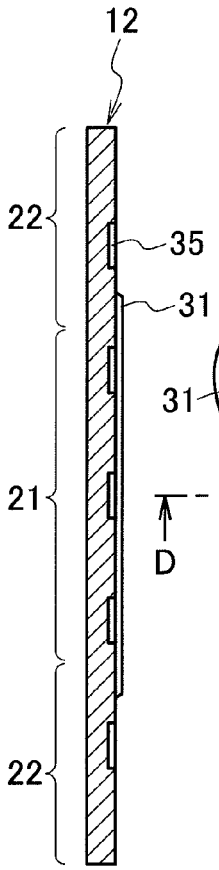
FIGS. 3A to 3D are diagrams illustrating a shape when the conductor crimping portion of the crimping terminal is exploded.
Figure 3A:
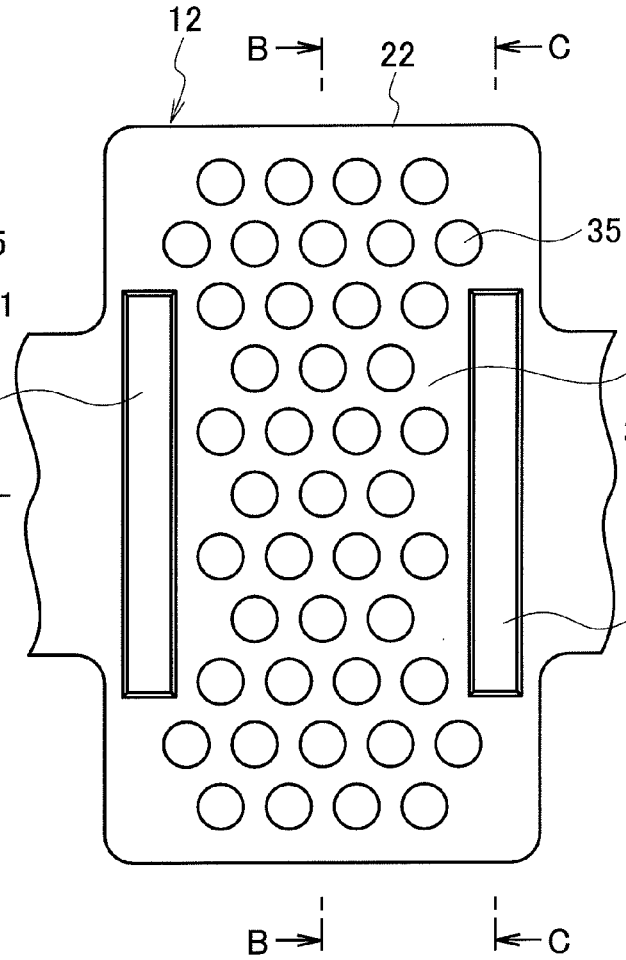
Figure 3C:
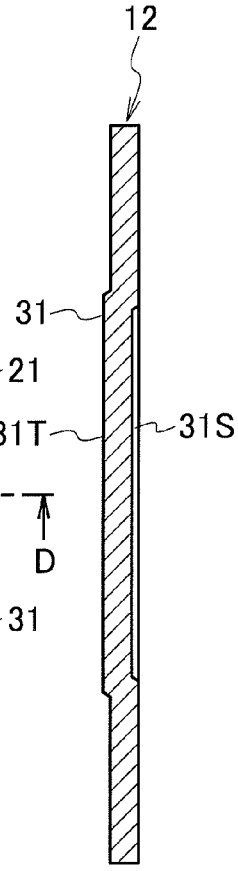
Figure 3D:
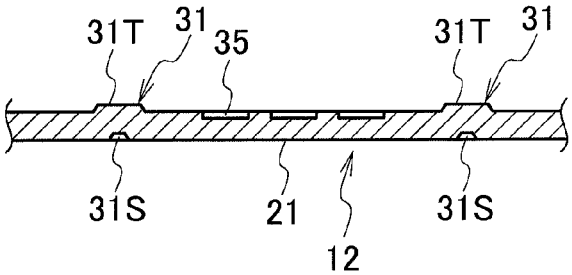

As illustrated in FIGS. 2 and 3A, beads 31 are formed in the conductor crimping portion 12 at the stage where the crimping terminal 10 is formed in a flatly exploded shape by pressing. Each bead 31 is formed as a projection 31T which has a trapezoid cross-section and protrudes toward the conductor W on the bottom plate 21. This shape may be formed by stamping the sheet which forms the conductor crimping portion 12 from the outer surface (the outer surface during the crimping operation) thereof so as to be recessed (the stamped recess is denoted by the reference sign 31S of the drawing). Further, the bead 31 is formed so as to extend in the left-right direction (that is, the direction perpendicular to the lengthwise direction). The bead 31 is positioned at the front and back ends of at least a part of the conductor crimping portion 12 from the bottom plate 21 of the conductor crimping portion 12 to the conductor crimping tab 22 thereof, wherein the part is curled so as to wrap the conductor W of the electric cable when crimping the conductor W. In other words, the bead 31 is provided in the inner surface of the conductor crimping portion 12 so as to be positioned at the front and back sides of serrations 35 (to be described later) in the lengthwise direction of the crimping terminal 10.

Further, the serrations 35 are formed in the inner surface of the conductor crimping portion 12. Each serration 35 has an uneven surface which comes into contact with the conductor W, and retains the conductor W inside the conductor crimping portion 12. Due to this retaining state, the serration 35 is provided in the region between the front and back beads 31 or the vicinities of the respective beads 31, and includes plural recesses. The plural recesses are independently provided so as to be spaced from each other. In this case, as illustrated in FIG. 3A, the respective recesses are staggered. Specifically, the respective recesses are arrayed in the left-right direction of the crimping terminal, and are staggered in the lengthwise direction of the crimping terminal. Since the plural recesses may be distributed so as to be line-symmetrical to each other in the lengthwise direction and the left-right direction of the crimping terminal, the respective recesses are arrayed in the lengthwise direction of the crimping terminal and are staggered in the left-right direction of the crimping terminal. The shape of each recess is, for example, a circular shape (a circle, an oval, or the like) or a quadrilateral shape (a square, a rectangular, a parallelogram, an argyle, or the like). Further, all recesses may have the same shape.

After the crimping terminal 10 is flatly exploded by pressing, the electric connection portion 11, the conductor crimping portion 12, or the sheath crimping portion 13 is bent as the next pressing step. For example, the conductor crimping portion 12 is bent toward the direction M so as to have a U-shaped cross-section (see FIG. 4).

The next operation is performed so as to crimp the conductor crimping portion 12 of the crimping terminal 10 at the conductor W of the front end of the electric cable. The crimping terminal 10 is placed on a placement table (an upper surface) of a lower die (an anvil) (not illustrated). Furthermore, the conductor W is placed on the upper surface (the inner surface) of the bottom plate 21 between the conductor crimping tabs 22 and 22. Then, an upper die (a clamper) (not illustrated) is moved down, so that the guiding surface of the upper die gradually rounds the conductor crimping tab 22 inward from the front end side thereof. Finally, the guiding surface of the upper die rounds the front ends of the conductor crimping tabs 22 so as to be folded toward the conductor W, whereby the front ends of the conductor crimping tabs 22 and 22 bite into the conductor W while coming into contact with each other. As a result, the conductor W is crimped so as to be wrapped by the conductor crimping tabs 22 (see FIG. 6).

By the above-described operations, the conductor crimping portion 12 of the crimping terminal 10 can be connected to the conductor W of the electric cable by crimping. Furthermore, the same crimping operation is performed on the sheath crimping portion 13. As a result, the crimping terminal 10 can be electrically and mechanically connected to the electric cable.

According to the crimping terminal 10, the bead 31 is formed so as to be stretched in the left-right direction at the front and back ends of a portion from the bottom plate 21 of the conductor crimping portion 12 to the conductor crimping tab 22 thereof. The bead 31 can improve the rigidity of a portion where the bead is provided. Thus, the deformation (i.e. the movement causing expansion or contraction) in the event of thermal shock can be suppressed to be small, and it is possible to reduce the relative deviation of the terminal with respect to the electrical cable or vice versa in a boundary therebetween due to the repeated deformation by the thermal shock. Therefore, it is possible to stably suppress an increase in the contact resistance between the terminal and the electric cable can be stably suppressed for a long period of time.

Figure 8:
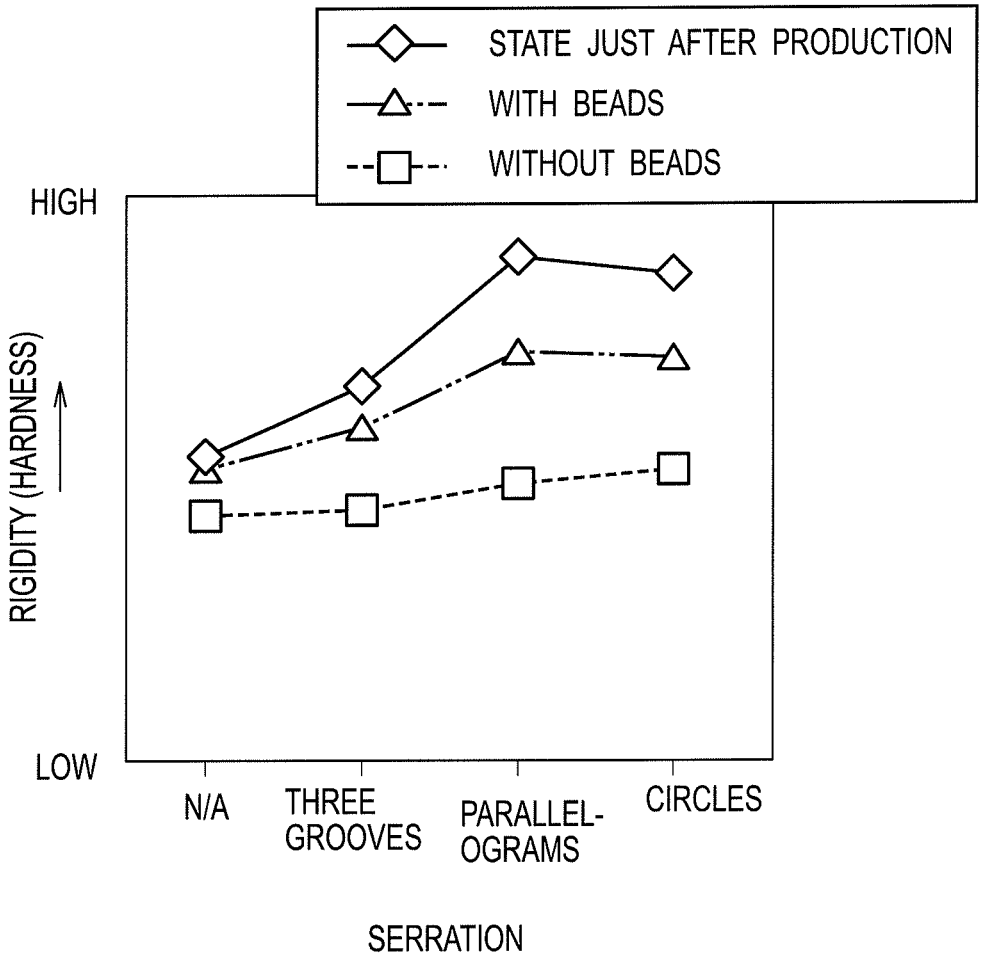
FIG. 8 is a characteristic diagram illustrating a change in hardness after thermal shock due to the presence of the bead, the presence of the serration, or a difference in the shape thereof.

FIG. 8 is a characteristic diagram illustrating a change in the rigidity (the hardness) of the crimping terminal 10 (the conductor crimping portion 12) at the time of forming the bead 31 or the serration 35, immediately after forming recesses with various shapes as the serration 35, and before and after the thermal shock. As illustrated in FIG. 8, in the case with the bead, the rigidity of the terminal after the thermal shock may be made to be similar to the rigidity of the initially produced terminal compared to the case without the bead.

The terminal with the serration has higher initial hardness than that of the terminal without the serration. This is because of work hardening with the formed serration. Further, the effect of work hardening with the formed serration becomes more apparent in the terminal with plural circle or parallelogram recesses as the serration than the terminal with three grooves as the serration. Incidentally, even in the terminal with the serration, if the terminal does not have the bead, the effect of work hardening with the formed serration disappears after the thermal shock. On the contrary, in the terminal with both the serration and the bead, the terminal is hardly affected by the thermal shock and has a value similar to the initial rigidity. Thus, when the bead 31 is provided, the effect of work hardening which is obtained by the formed serration can be maintained as much as possible even after the thermal shock. Further, the rigidity of the conductor crimping portion can be improved by providing the bead 31.

According to the crimping terminal 10 of the embodiment, when the bead 31 is provided at the front and back ends of the conductor crimping portion 12, both the conductor W of the electric cable and the conductor crimping portion 12 can be suppressed from being stretched.

Figure 7A:
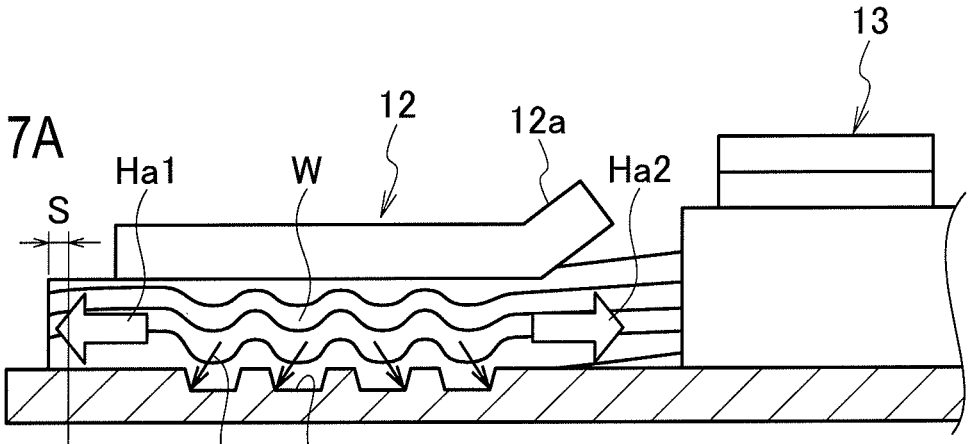
FIGS. 7A and 7B are longitudinal cross-sectional views illustrating a difference in movement between a crimping terminal without a bead provided in a conductor crimping portion and a crimping terminal with a bead of the embodiment at the time of crimping.
Figure 7B:
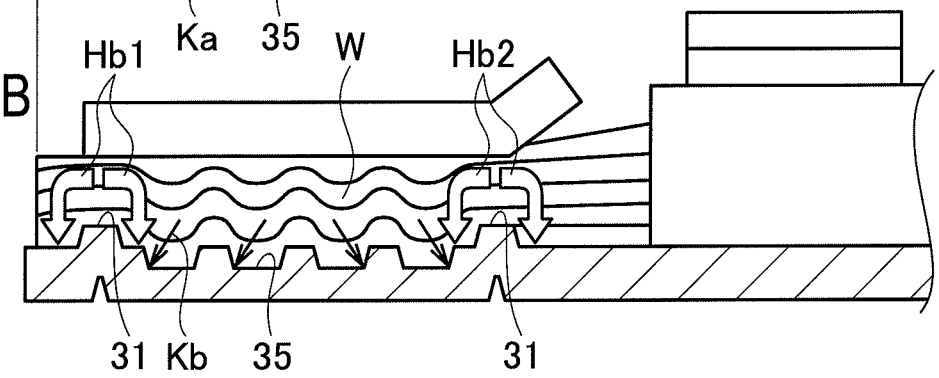

That is, when the case without the bead 31 (FIG. 7A) and the case with the bead 31 (FIG. 7B) are compared with each other, in the case with the bead 31, the compressing force which is applied from the portion with the bead 31 to the conductor W locally increases, so that the conductor W hardly escapes to the outside of the bead. For example, as illustrated in FIG. 7A, in the case without the bead 31, the conductor W escapes in the front direction indicated by the arrow Ha1 and the back direction indicated by Ha2. As a result, the conductor W is stretched forward by the length S, so that the portion moving toward the serration 35 is reduced. On the contrary, as illustrated in FIG. 7B, in the case with the bead 31, the bead 31 serves as an obstacle with respect to the movement of the conductor W. Thus, the conductor W may not easily escape in the front direction and the back direction which are respectively indicated by the arrows Hb1 and Hb2. That is, the bead 31 can suppress the conductor W from being stretched and suppress the conductor crimping portion 12 from being stretched.

Further, the pressure Kb which is applied to the conductor W between the beads 31 can be increased without excessively compressing the conductor crimping portion 12. Furthermore, in the case without the bead, the pressure Ka which is applied to the conductor W is small. In this way, since the high pressure Kb which is applied to the conductor W is obtained, all recesses which serve as the serrations 35 provided between the beads 31 can sufficiently bite into the conductor W. For example, in the case without the bead 31, with regard to the serration 35 in the vicinity of the front end or the back end of the conductor crimping portion 12, the pressure applied to the conductor W becomes smaller, whereby the serration may not easily bite into the conductor W. However, as indicated by the arrow G of FIG. 6, even the serration 35 in the vicinity of the front end or the back end thereof can easily bite into the conductor W by the bead 31. Further, since the pressure applied to the conductor W between the beads 31 can be increased, the contact pressure between the conductor W and the conductor crimping portion 12 can be increased, and a newly-formed surface which is formed by the peeling of an oxide coating or the like can be more easily formed. Thus, the electrical connection performance between the electric cable and the terminal can be improved.

Further, since there is no need to excessively compress the conductor crimping portion 12, a decrease in the cross-sectional area of the conductor during the crimping operation can be suppressed as small as possible. Thus, the strength of the conductor W in the tensile direction can be improved. Further, since both the electrical connection performance and the fixation performance between the crimping terminal and the electric cable can be improved without excessively compressing the crimping terminal and the electric cable, a wide range of compressibility of the conductor crimping portion 12 can be ensured during the crimping operation and the production management thereof becomes easier.

Further, according to the crimping terminal 10 of the embodiment, since plural circular recesses are provided as the serration 35, the following effect can be obtained.

That is, when the conductor crimping portion 12 is compressed against the conductor W of the electric cable by using the crimping terminal 10, the conductor W of the electric cable are plastically deformed so as to enter into the respective small circular recesses provided as the serration 35 in the inner surface of the conductor crimping portion 12. Thus, the bonded state between the crimping terminal 10 and the conductor W can be reinforced. At this time, due to the friction between the edges of the respective recesses and the surface of the conductor which moves by the pressure or the friction between the inner surface of the recess and the surface of the conductor which enters into the recess, the oxide coating of the surface of the conductor W is peeled off, so that a newly-formed surface is exposed and is electrically connected to the terminal. Furthermore, since plural small circular recesses are provided in the crimping terminal 10 so as to be scattered, the total length of the hole edge of the recess can be effectively used to scrape the oxide coating away regardless of the tensile direction of the conductor W. Thus, it is possible to improve the electrical connection effect due to the exposure of the newly-formed surface compared to the crimping terminal in which the linear serration is provided so as to intersect with the extension direction of the conductor W of the electric cable.

Further, plural serrations 35 which include circular recesses are formed between the front and back beads 31 and 31, and by the combination of the beads 31 and the serrations 35 including plural circular recesses, the pressure Kb of the conductor W with respect to the serration 35 can be further increased and the conductor W and the newly-formed surface of the conductor crimping portion 12 can be further rigidly bonded to each other. Furthermore, the shape of the recess (especially, the shape of the opening) as the serration 35 of the embodiment is not limited, but a circular shape is desirable. This is because the deformation of the circular recess does not occur or is relatively suppressed compared to the recess with a corner portion from the viewpoint of the deformation of the serration due to the press-inserting pressure of the conductor W. Since the deformation is suppressed, the relative sliding amount between the conductor W of the electric cable and the conductor crimping portion 12 of the crimping terminal 10 increases and the exposure area of the newly-formed surface increases. As a result, the newly-formed surfaces can be rigidly bonded to each other. Especially, when the fact in which the bead 31 further increases the press-inserting pressure (the pressure Kb) of the conductor W is taken into consideration, the circular recess may be more suitable as the serration compared to the recess with the corner portion which is easily deformable.

Further, if forming a serration including at least one linearly stretched groove by pressing, a linear projection needs to be formed in the pressing mold, and such projection needs to be formed by grinding. On the other hand, when plural circular projections are formed in the pressing mold so as to process the serration, it is easy to use a processing method other than the above-described grinding. For example, when a linear projection is formed in the pressing mold, if the projection needs to be formed by electro-discharge machining, there is a need to form a linear recess in a discharge electrode. In fact, since it is very difficult to form the linear recess in a metal block, the linear projection is not easily formed by the electro-discharge machining. However, when plural circular projections are formed in the pressing mold so as to process the serration, the projections of the mold can be easily formed by the electro-discharge machining. For example, when the circular projection is formed by the electro-discharge machining, the plural circular projections can be transferred to the mold just by drilling a base block as an electrode so as to form round holes as plural circular recesses. Thus, the processing can be easily performed.

Next, an example of the serration of the embodiment will be described by referring to FIGS. 9 to 11.

Figure 9:
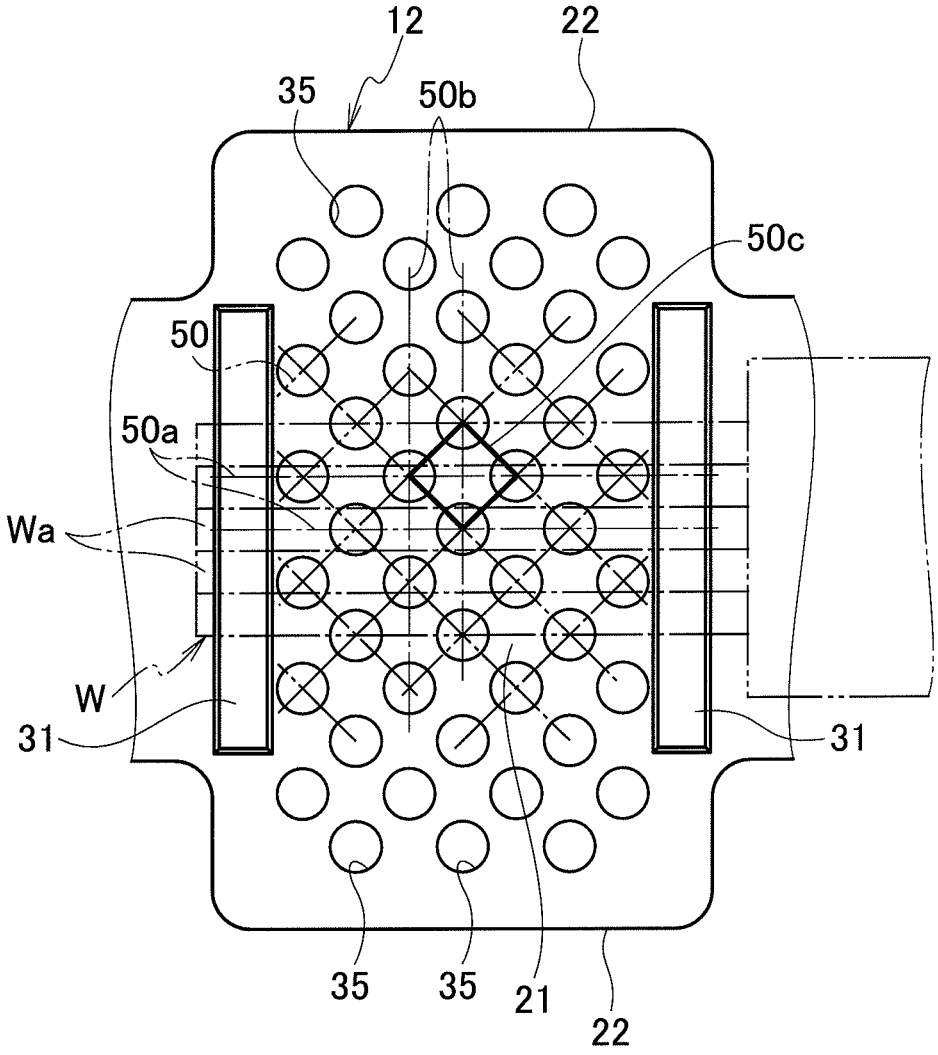
FIG. 9 is a main exploded diagram illustrating an example of the array pattern of the serrations formed in the inner surface of the conductor crimping portion.

As illustrated in FIG. 9, it is assumed that a grid 50 is formed in the inner surface of the conductor crimping portion 12, that is, the range from the inner surface of the bottom plate 21 to the inner surface of the conductor crimping tab 22. In FIG. 9, the grid 50 is indicated by the two-dotted chain line, and obliquely intersects with the lengthwise direction of the crimping terminal 10. Further, the grid 50 also substantially intersects with the lengthwise direction of the conductor W. The recess which serves as the serration 35 is positioned at each grid point (the intersection point) of the grid 50. All recesses on the grid points have the same shape. That is, when the recess is circular, all recesses have the same radius and the same depth.

The grid 50 includes plural quadrilateral unit frames (unit grids) 50*c* each of which is formed by four adjacent recesses serving as grid points. The unit frame 50*c* includes two diagonal lines 50*a* and 50*b*. The diagonal line (the first diagonal line) 50*a* is positioned along the lengthwise direction of the crimping terminal 10 (or the lengthwise direction of the conductor W), and the diagonal line (the second diagonal line) 50*b* is positioned so as to be perpendicular to the lengthwise direction of the crimping terminal 10 (or the lengthwise direction of the conductor W). Further, the grid 50 is positioned along the circumferential direction of the conductor W.

As illustrated in FIG. 9, the diagonal line 50*a* and the diagonal line 50*b* intersect with each other and have the same length. That is, the unit frame 50*c* has a square shape.

When the crimping terminal 10 crimps the conductor W, the conductor W is press-inserted into the serration (that is, the recess) 35. At this time, the edge of the serration 35 tears the oxide coating of the surface of the conductor W, so that the newly-formed surface therebelow is exposed. As a result, the newly-formed surface and the serration 35 come into close contact with each other, so that the electrical resistance between the crimping terminal 10 and the conductor W can be decreased. Further, when the conductor W is press-inserted into the serration (the recess) 35, the conductor W is caught by the edge of the serration 35, so that the mechanical connection strength can be improved.

Further, since the serration 35 is formed in almost the entire inner surface of the conductor crimping portion 12, damage which is applied to each wire Wa of the conductor W during the crimping operation (in other words, the compressibility) can be dispersed. The dispersion of the damage is particularly effective for the conductor W which is formed by twisting and binding the wires Wa. Further, since the mechanical connection strength can be stably improved and the edge length of the serration 35 can be sufficiently ensured, the newly-formed surface can be formed in the wide range of the surface of the conductor W. Thus, the low electrical connection resistance can be stably maintained.

As described above, the serration (the recess) 35 is disposed at each grid point of the grid 50, and the grid 50 is formed by plural unit frames 50*c*. The first diagonal line 50*a* of the unit frame 50*c* is positioned along the lengthwise direction of the crimping terminal 10, and the second diagonal line 50*b* is positioned so as to be perpendicular to the first diagonal line 50*a*. In other words, the first diagonal line 50*a* is positioned along the lengthwise direction of the conductor W, and the second diagonal line 50*b* is positioned along the circumferential direction of the conductor W. The lengths of the diagonal lines 50*a* and 50*b* are equal to each other, and the unit frame 50*c* forms a square shape. Thus, the low electrical connection resistance and the mechanical connection strength between the conductor W and the crimping terminal 10 can be obtained with a good balance in space and be reinforced, and can be stably maintained.

Figure 10:
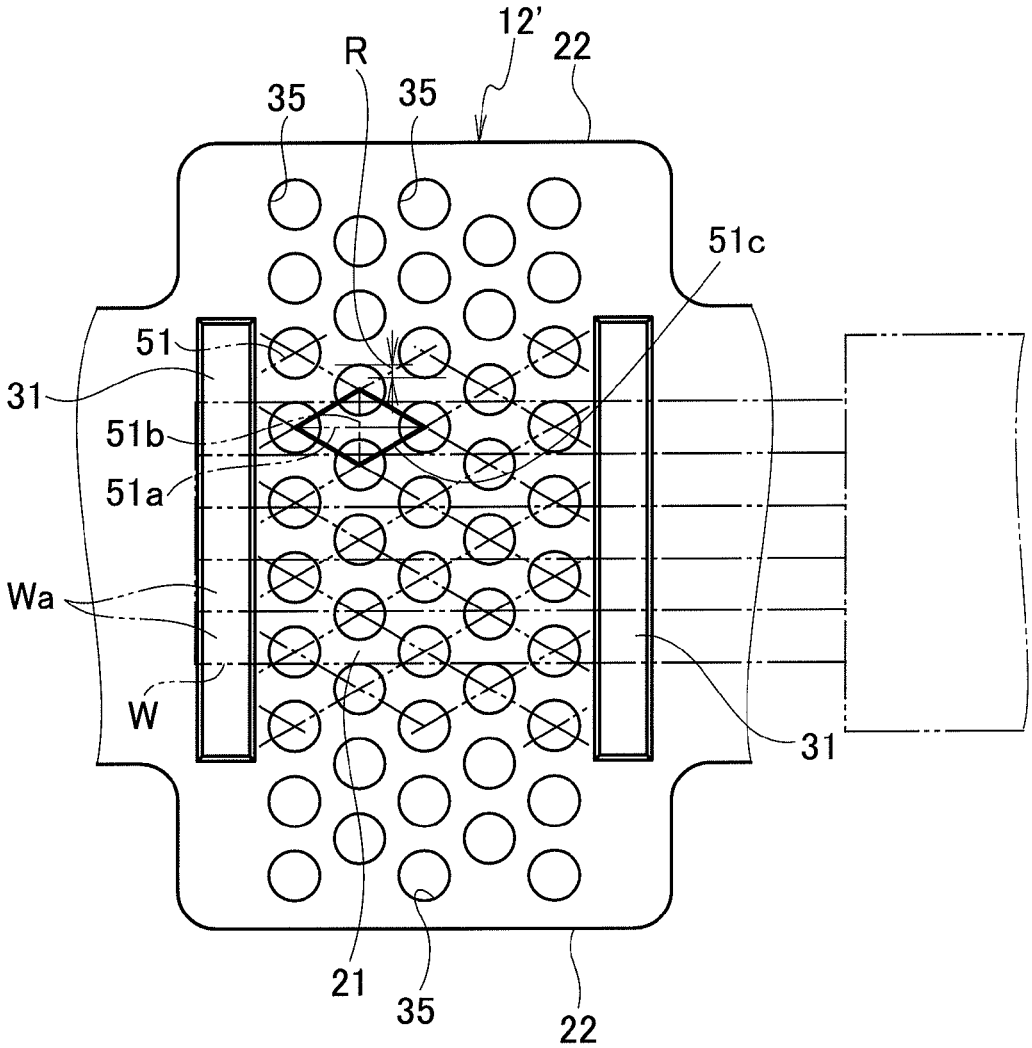
FIG. 10 is a main exploded diagram illustrating another example of the array pattern of the serrations.

FIG. 10 illustrates another example of the array pattern of the serration 35 which is formed in an inner surface of a conductor crimping portion 12'.

As in the above-described conductor crimping portion 12, plural circular recesses which serve as the serrations 35 are arrayed even in the conductor crimping portion 12'. Each recess is positioned at each grid point (the intersection point) of a grid 51. The grid 51 includes plural unit frames (unit grids) 51*c*, and each unit frame 51*c* includes a first diagonal line 51*a* and a second diagonal line 51*b*. The first diagonal line 51*a* is positioned along the lengthwise direction of the crimping terminal 10, and the second diagonal line 51*b* is positioned so as to be perpendicular to the first diagonal line 51*a*. In other words, the first diagonal line 51*a* is positioned along the lengthwise direction of the conductor W, and the second diagonal line 51*b* is positioned so as to be perpendicular to the lengthwise direction of the conductor W. As illustrated in FIG. 10, the first diagonal line 51*a* is longer than the second diagonal line 51*b*. That is, the unit frame 51*c* of the grid 51 is formed in an argyle shape which is long in the lengthwise direction of the crimping terminal 10. In this example, the serrations (the recesses) 35 which are stretched in a row in the left-right direction of the crimping terminal 10 and are adjacent to each other overlap each other when seen from the lengthwise direction of the crimping terminal 10 (the front-back direction). In FIG. 10, the overlapping portion is indicated by the reference sign R. That is, the interval of the recesses, which are arrayed along the lengthwise direction of the conductor W (the crimping terminal 10), is wider than the interval of the recesses that are arrayed along the circumferential direction of the conductor W.

As described above, the first diagonal line 51*a* of the grid 51 is positioned along the lengthwise direction of the crimping terminal 10, and the second diagonal line 51*b* is positioned so as to be perpendicular to the lengthwise direction of the crimping terminal 10. Furthermore, the first diagonal line 51*a* is longer than the second diagonal line 51*b*. The serration (the recess) 35 is arrayed in the grid point (the intersection point) of the grid 51. Thus, since the interval between the recesses serving as the serrations 35 in the circumferential direction of the conductor W is narrower than the interval between the recesses in the lengthwise direction of the conductor W, a newly-formed surface in which the edge of the serration 35 is wide is formed. As a result, the electrical connection resistance between the conductor W and the crimping terminal 10 decreases and the connection resistance can be stably maintained.

Further, in the conductor W which is formed by twisting and binding the wires Wa, the edges of the serrations 35 crimp the respective wires Wa without a speck therein due to the dense array of the serrations 35 along the circumferential direction of the conductor W. Furthermore, since the interval between the serrations 35 in the lengthwise direction of the conductor W becomes wider, damage which is applied to each wire Wa during the crimping operation can be dispersed. Thus, it is possible to suppress the damage which is caused by the thin wire diameter of the wire Wa forming the conductor W. Further, sufficient mechanical connection strength can be obtained between the conductor W and the crimping terminal 10, and low electrical connection resistance between the conductor W and the crimping terminal 10 can be stably maintained.

Figure 11:
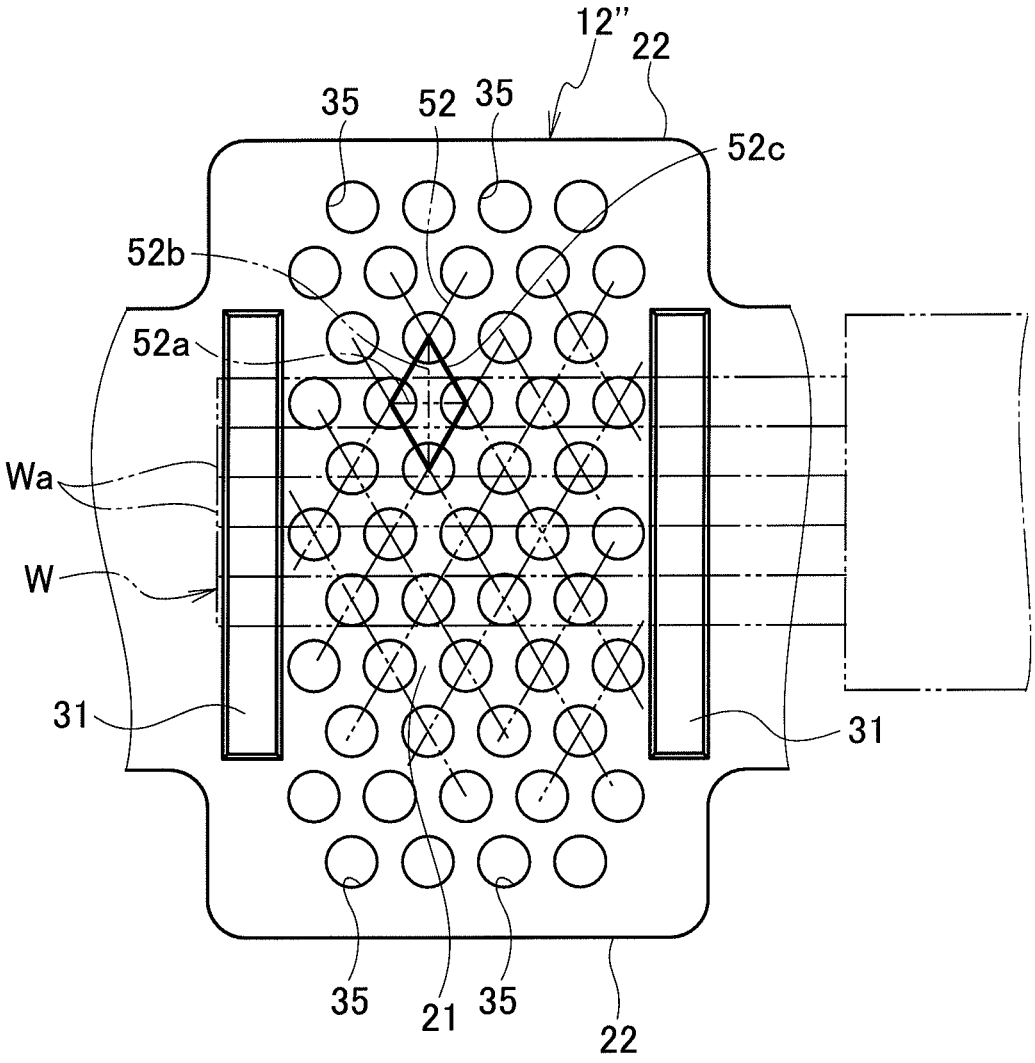
FIG. 11 is a main exploded diagram illustrating another example of the array pattern of the serrations.

FIG. 11 illustrates another example of the array pattern of the serration 35 which is formed in an inner surface of a conductor crimping portion 12".

As in the above-described conductor crimping portion 12, plural circular recesses which serve as the serrations 35 are arrayed even in the conductor crimping portion 12". Each recess is positioned at each grid point (the intersection point) of a grid 52. The grid 52 includes plural unit frames (unit grids) 52*c*, and each unit frame 52*c* includes a first diagonal line 52*a* and a second diagonal line 52*b*. The first diagonal line 52*a* is positioned along the lengthwise direction of the crimping terminal 10, and the second diagonal line 52*b* is positioned so as to be perpendicular to the first diagonal line 52*a*. In other words, the first diagonal line 52*a* is positioned along the lengthwise direction of the conductor W, and the second diagonal line 52*b* is positioned so as to be perpendicular to the lengthwise direction of the conductor W. As illustrated in FIG. 11, the first diagonal line 52*a* is shorter than the second diagonal line 52*b*. That is, the unit frame 52*c* of the grid 52 is formed in an argyle shape which is long in the left-right direction of the crimping terminal 10. In this example, the serrations (the recesses) 35 which are stretched in a row in the lengthwise direction of the crimping terminal 10 and are adjacent to each other overlap each other when seen from the left-right direction of the crimping terminal 10. That is, the interval of the recesses, which are arrayed along the lengthwise direction of the conductor W (the crimping terminal 10), is narrower than the interval of the recesses which abackrayed along the circumferential direction of the conductor W (the left-right direction of the crimping terminal 10).

As described above, the first diagonal line 52*a* of the grid 52 is positioned along the lengthwise direction of the crimping terminal 10, and the second diagonal line 52*b* is positioned so as to be perpendicular to the lengthwise direction of the crimping terminal 10. Furthermore, the first diagonal line 52*a* is shorter than the second diagonal line 52*b*. The serration (the recess) 35 is arrayed at the grid point (the intersection point) of the grid 52. Thus, since the interval between the recesses which serve as the serrations 35 in the lengthwise direction of the conductor W is narrow, a newly-formed surface in which the edge of the serration 35 is wide is formed. As a result, the electrical connection resistance between the conductor W and the crimping terminal 10 decreases and the connection resistance can be stably maintained.

Further, since the serrations 35 are densely arrayed along the lengthwise direction of the crimping terminal 10, the number of contact points between the conductor W and the serrations 35 increases along the lengthwise direction during the crimping operation. Thus, even when a load is applied in the direction where the conductor W is extracted from the crimping terminal 10, sufficient mechanical connection strength between the conductor W and the crimping terminal 10 can be obtained and be stably maintained.

Further, the conductor W may be formed by a single conductive wire or twisting plural wires Wa with a comparatively large diameter. In this way, when the number of the wires Wa forming the conductor W is small, the conductor W is comparatively strong against mechanical damage. Even in the conductor W, the array of the serrations 35 illustrated in FIG. 11 can obtain sufficient mechanical connection strength between the crimping terminal 10 and the conductor and stably maintain low electrical connection resistance therebetween.

Figure 12:
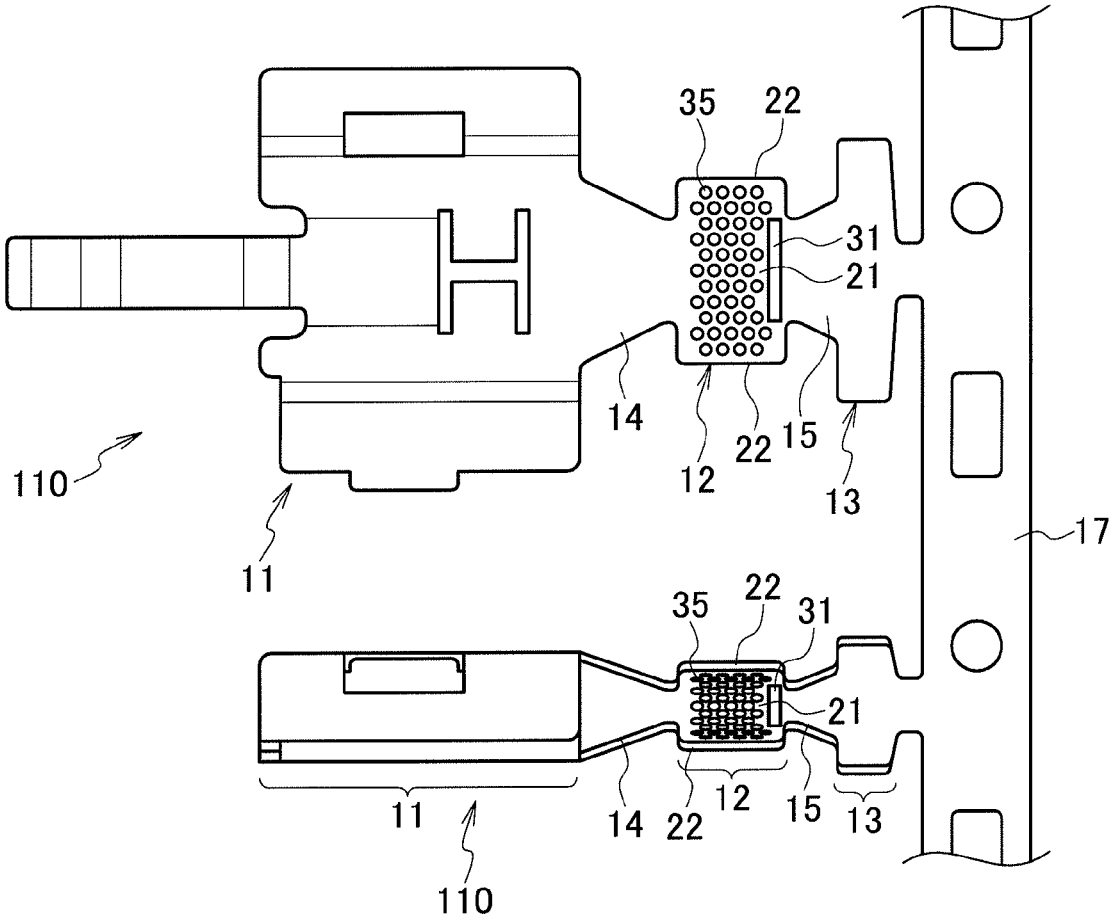
FIG. 12 is a plan view illustrating a shape of a crimping terminal of a second embodiment of the invention, which illustrates a shape when the crimping terminal is exploded after it is produced by pressing and a shape when the crimping terminal is used as a product.

FIG. 12 is a plan view illustrating a shape of a crimping terminal of a second embodiment of the invention, which illustrates a shape when the crimping terminal is exploded after it is produced by pressing and a shape when the crimping terminal is used as a product.

In a crimping terminal 110 of the second embodiment, the bead 31 is provided only at the back end of a part of the conductor crimping portion 12 from the bottom plate 21 of the conductor crimping portion 12 to the conductor crimping tab 22 thereof, wherein the part is curled so as to wrap the conductor W of the electric cable when crimping the conductor W. In other words, the bead 31 is provided only at the back side of the serration 35 in the lengthwise direction of the crimping terminal 110 in the inner surface of the conductor crimping portion 12. Further, the same serrations 35 as those of the first embodiment (see FIGS. 9 to 11) are provide in a region on the front side of the bead 31 in the inner surface of the conductor crimping portion 12. The other configuration is the same as that of the first embodiment except that the bead 31 is provided only at the back end of the conductor crimping portion 12.

Even in the crimping terminal 110 of the embodiment, the same effect as that of the crimping terminal 10 of the first embodiment is obtained. That is, the bead 31 is provided at the back end of a portion from the bottom plate 21 of the conductor crimping portion 12 to the conductor crimping tab 22 so as to be stretched in the left-right direction. The bead 31 can improve the rigidity of the portion where the bead is provided. Thus, the deformation (i.e. the movement causing expansion or contraction) in the event of thermal shock can be suppressed to be small, and it is possible to reduce the relative deviation of the crimping terminal 110 with respect to the electrical cable or vice versa in the boundary therebetween due to the repeated deformation with the thermal shock. Therefore, it is possible to stably suppress an increase in the contact resistance between the terminal and the electric cable.

Further, since the bead 31 is provided at the back end of the conductor crimping portion 12, the conductor W of the electric cable can be suppressed from being stretched to the back side of the crimping terminal 110. That is, since the compressing force with respect to the conductor W locally increases in the portion provided with the bead 31, the conductor W may not easily escape to the outside of the bead 31. As a result, the conductor W can be suppressed from being stretched backward and the crimping terminal 110 can be suppressed from being stretched backward.

Further, the pressure with respect to the conductor W can be increased without excessively compressing the conductor crimping portion 12. Thus, all recesses which serve as the serrations 35 formed on the front side of the bead 31 can sufficiently bite into the conductor W. For example, in the case without the bead 31, since the pressure with respect to the conductor W decreases in the serrations 35 near the back end of the conductor crimping portion 12, the serrations may not easily enter into the conductor W. Especially, when a bell mouth 12*a* which is inclined outward and widened so as to escape from the surface of the conductor W (see FIGS. 5 and 7) is formed at the back end of the conductor crimping portion 12, the serration 35 therearound may not easily enter into the conductor W. However, when the bead 31 is formed, even the serration 35 near the back end can sufficiently enter into the conductor W.

Further, since the bead 31 increases the pressure with respect to the conductor W, the contact pressure between the conductor W and the crimping terminal 110 can be increased and the newly-formed surface can be more easily generated. Thus, the electrical connection performance between the conductor W and the crimping terminal 110 can be improved.

Further, since there is no need to excessively compress the conductor crimping portion 12, it is possible to suppress a decrease in the cross-sectional area of the conductor during the crimping operation. Thus, the strength of the conductor W in the tensile direction can be improved. Since both the electrical connection performance and the fixation performance between the crimping terminal and the electric cable can be improved without excessively compressing the crimping terminal and the electric cable, a wide range of compressibility of the conductor crimping portion 12 can be ensured during the crimping operation and the production management thereof becomes easier.

Furthermore, in the above-described respective embodiments, an example has been described in which the bead 31 is formed by pressing while the conductor crimping portion 12 is flatly exploded, but the bead may be formed at the same time of bending when the conductor crimping portion 12 is bent by a bending mold so as to have a U-shaped cross-section. In this case, a projection can be formed in the lower die so as to process the recess of the lower surface of the bead, and a recess may be formed in the upper die so as to process the projection of the upper surface of the bead.

Further, in the above-described respective embodiments, plural circular recesses are used as the serrations 35. However, the shape of the recess which serves as the serration 35 according to the present invention is not limited to the circular shape. For example, as described above, the shape of the recess may be a parallelogram shape. Further, the recess may have a groove shape which linearly extends toward a direction intersecting with the axial direction of the conductor.

Further, in the above-described first embodiment, each bead 31 is formed at the front and back ends of the conductor crimping portion 12. However, one bead may be further provided between the beads 31 of the front and back ends.

What is claimed is:

1. A crimping terminal comprising:

an electric connection portion; and a conductor crimping portion provided at a back side of the electric connection portion in a lengthwise direction thereof, the conductor crimping portion being connected to a conductor exposed at a front end of an electric cable so as to crimp the conductor, the conductor crimping portion including:

a bottom plate on which the conductor is placed, a pair of conductor crimping tabs configured to crimp the conductor on the bottom plate so as to wrap the conductor, the conductor crimping tabs being formed so as to extend from left and right sides of the bottom plate when seen from the lengthwise direction, serrations configured to retain the conductor inside the conductor crimping portion, the serrations being formed in at least a part of an inner surface of the conductor crimping portion, the part being curled so as to wrap the conductor when crimping the conductor, the serrations including recesses independently provided so as to be spaced from each other and at least one bead formed extending in a direction perpendicular to the lengthwise direction and being formed protruding from the inner surface of the conductor crimping portion toward the conductor on the bottom plate, the at least one bead being provided at the back side of the serrations in the lengthwise direction or the back and front sides of the serrations in the lengthwise direction in the inner surface of the conductor crimping portion.

2. The crimping terminal according to claim 1, wherein the at least one bead is formed by stamping a sheet forming the conductor crimping portion from an outer surface of the sheet.

3. The crimping terminal according to claim 2, wherein the recesses are staggered.

4. The crimping terminal according to claim 3, wherein the recesses are formed in a circular shape.

5. The crimping terminal according to claim 4, wherein the recesses have the same shape.

6. The crimping terminal according to claim 5, wherein the recesses form a grid comprising a plurality of quadrilateral unit frames each of which is formed by the plurality of recesses serving as grid points, a first diagonal line of each unit frame is positioned along the lengthwise direction of the crimping terminal, and a second diagonal line of each unit frame is positioned so as to be perpendicular to the lengthwise direction of the crimping terminal.

7. The crimping terminal according to claim 6, wherein the first and second diagonal lines have the same length.

8. The crimping terminal according to claim 6, wherein the first diagonal line is longer than the second diagonal line.

9. The crimping terminal according to claim 8, wherein a recess on the second diagonal line of the recesses partly overlaps the other recess on the first diagonal line of the recesses when seen from the extension direction of the first diagonal line.

10. The crimping terminal according to claim 6, wherein the second diagonal line is longer than the first diagonal line.

11. The crimping terminal according to claim 10, wherein a recess on the first diagonal line of the recesses partly overlaps the other recess on the second diagonal line of the recesses when seen from the extension direction of the second diagonal line.

* * * * *